US009677456B2

(12) United States Patent
Medda et al.

(10) Patent No.: US 9,677,456 B2
(45) Date of Patent: Jun. 13, 2017

(54) VEHICLE DRIVEN BY AN INTERNAL COMBUSTION ENGINE AND PROVIDED WITH A LIQUID COOLING SYSTEM

(71) Applicant: Ferrari S.p.A., Modena (IT)

(72) Inventors: Massimo Medda, Sassuolo (IT); Davide Frigeri, Modena (IT)

(73) Assignee: Ferrari S.p.A., Modena (IT)

( * ) Notice: Subject to any disclaimer, the term of this patent is extended or adjusted under 35 U.S.C. 154(b) by 220 days.

(21) Appl. No.: 14/710,019

(22) Filed: May 12, 2015

(65) Prior Publication Data

US 2015/0330285 A1 Nov. 19, 2015

(30) Foreign Application Priority Data

May 13, 2014 (IT) ..... BO2014A0287

(51) Int. Cl.
*F01P 5/10* (2006.01)
*F01P 3/02* (2006.01)
*F01P 7/14* (2006.01)

(52) U.S. Cl.
CPC ..... *F01P 3/02* (2013.01); *F01P 2003/028* (2013.01); *F01P 2007/146* (2013.01);
(Continued)

(58) Field of Classification Search
CPC ..... F01P 2003/028; F01P 2007/146; F01P 2060/04; F01P 2060/08; F01P 2060/12; F01P 3/02; F01P 2003/027; F01P 7/16; F01P 7/14; F01P 2003/021; F01P 2003/024; F01P 5/10; F01P 3/00; F01P 2025/04;
(Continued)

(56) References Cited

U.S. PATENT DOCUMENTS 4,319,547 A * 3/1982 Bierling ..... F01P 7/165 123/41.08
4,423,705 A * 1/1984 Morita ..... F01P 5/12 123/41.02
(Continued)

FOREIGN PATENT DOCUMENTS

DE WO 2009143866 A1 * 12/2009 ..... F01P 3/02
DE 10 2011 117 102 A1 5/2012
(Continued)

OTHER PUBLICATIONS

WO 2009143866 translation.*

*Primary Examiner* — Marguerite McMahon
*Assistant Examiner* — Tea Holbrook
(74) *Attorney, Agent, or Firm* — Blank Rome LLP

(57) ABSTRACT

A vehicle having: an internal combustion engine provided with a plurality of cylinders, at least one cylinder block, in which the cylinders are located, and at least one head, which is fixed to the cylinder block, and a liquid cooling system, comprising a hydraulic circuit, inside of which a coolant flows, which is circulated by a circulation pump. The hydraulic circuit has an initial section, which is located inside the head of the internal combustion engine, and a final section, which is obtained inside the cylinder block of the internal combustion engine. In the hydraulic circuit, the delivery of the circulation pump is directly connected to the inlet of the initial section, and the outlet of the initial section is directly connected to the inlet of the final section.

13 Claims, 3 Drawing Sheets

(52) U.S. Cl.
CPC ..... *F01P 2060/04* (2013.01); *F01P 2060/08* (2013.01); *F01P 2060/12* (2013.01)

(58) Field of Classification Search
CPC .. F01P 2025/08; F02M 31/16; F02N 11/0837; F02N 19/04; F02N 2200/122; B60H 1/00885; F02B 29/0443; F02F 1/40
USPC ..... 123/41.01, 41.02, 41.05, 41.08, 41.29, 123/41.44, 41.78, 41.72
See application file for complete search history.

(56) References Cited

U.S. PATENT DOCUMENTS 4,759,316 A * 7/1988 Itakura ..... F01P 7/165 123/41.08
5,419,287 A * 5/1995 Evans ..... F01P 3/20 123/41.01
6,230,669 B1 * 5/2001 Evans ..... F01P 3/22 123/41.42
6,739,290 B2 * 5/2004 Iwasaki ..... F01P 7/164 123/41.01
6,880,535 B2 * 4/2005 Sorter ..... F02B 43/08 123/528
7,114,469 B1 * 10/2006 Taylor ..... B63H 21/00 123/195 P
7,458,417 B2 * 12/2008 Larson ..... F02B 29/0431 123/41.01
7,617,897 B2 * 11/2009 Hiroshima ..... B60K 11/02 180/68.4
2002/0170506 A1 * 11/2002 IIzuka ..... F01P 7/16 123/41.1
2004/0016411 A1 * 1/2004 Joyce ..... F01P 7/164 123/41.1
2008/0110433 A1 * 5/2008 Lee ..... F01P 11/04 123/196 AB
2011/0265741 A1 * 11/2011 Honzen ..... F01P 3/02 123/41.08
2013/0047940 A1 * 2/2013 Quix ..... F01P 7/165 123/41.08
2013/0125843 A1 * 5/2013 Fukuoka ..... F01P 3/02 123/41.1
2013/0186351 A1 * 7/2013 Quix ..... F01P 5/10 123/41.02
2014/0069522 A1 * 3/2014 Kuze ..... F01P 7/14 137/334
2014/0209046 A1 * 7/2014 Steiner ..... F01P 5/10 123/41.31
2015/0377114 A1 * 12/2015 Matsumoto ..... F02F 1/14 123/41.44

FOREIGN PATENT DOCUMENTS

GB 2 348 485 A 10/2000
IT FR 2594484 A1 * 8/1987 ..... F01P 3/02
JP 57165619 A * 10/1982 ..... F01P 7/165
JP 5583045 B2 * 9/2014
KR 20020081627 A * 10/2002

* cited by examiner

VEHICLE DRIVEN BY AN INTERNAL COMBUSTION ENGINE AND PROVIDED WITH A LIQUID COOLING SYSTEM

TECHNICAL FIELD

The present invention relates to a vehicle driven by an internal combustion engine and provided with a liquid cooling system.

PRIOR ART

A vehicle driven by an internal combustion engine normally comprises a liquid cooling system, the function of which is to keep the temperature of the internal combustion engine around an optimal value which allows to have high combustion efficiency without threatening the integrity of the internal combustion engine. Furthermore, the liquid cooling system may have other functions, e.g. cooling the driveline lubrication oil, cooling the turbocharger lubrication oil (if present) or heating (when required) the air which is introduced into the passenger compartment by the climate control system.

The cooling system comprises a hydraulic circuit, in which a coolant (typically water based) flows; the hydraulic circuit is partially developed inside the cylinder block and the head of the internal combustion engine (i.e. the hydraulic circuit comprises labyrinths obtained in the cylinder block and the head of the internal combustion engine) and develops partially outside the cylinder block and the head of the internal combustion engine. In particular, outside the head of the internal combustion engine the hydraulic circuit crosses a circulation pump (normally driven by the crankshaft of the internal combustion engine) and a radiator, in which the coolant releases heat to the external environment.

In the case of a high-performance road vehicle, the internal combustion engine has a high specific power. It has been observed that frequently in sporty use (i.e. when the internal combustion engine must deliver high powers for a long time), the head temperatures of a high specific power internal combustion engine are particularly high (i.e. the head temperatures are frequently even significantly higher than the optimal temperature); such a condition has evident disadvantages because it can cause an anomalous (i.e. faster) decay of the components sensitive to high temperature. Furthermore, it has been observed that during normal road use, a high specific power internal combustion engine is very slow to warm up (meaning the time needed to take the coolant to the optimal temperature) because of the low power which is delivered (which is always a modest fraction of the nominal power). The fuel consumption of a cold internal combustion engine is higher than that of a warm internal combustion engine, the delivered power being equal; therefore, if the warm-up takes longer, the greater fuel consumption caused by the internal combustion engine being cold becomes significant (i.e. not entirely negligible).

Patent application GB2348485A describes an internal combustion engine comprising: a plurality of cylinders housing respective pistons, a cylinder block, in which the cylinders are obtained, and at least one head, which is fixed to the cylinder block, defines the top of the cylinders and supports a distribution system. A liquid cooling system is provided comprising a hydraulic circuit, inside which a coolant, which is circulated by a circulation pump, flows; the hydraulic circuit comprises an initial section which is obtained in the head of the internal combustion engine and a final section which is obtained in the cylinder head of the internal combustion engine and is arranged hydraulically in series and downstream of the initial section (i.e. the final section receives the coolant from the initial section).

DESCRIPTION OF THE INVENTION

It is the object of the present invention to provide a vehicle driven by an internal combustion engine and provided with a liquid cooling system, which is free from the drawbacks described above and which is easy and cost-effective to make at the same time.

According to the present invention, a vehicle driven by an internal combustion engine and provided with a liquid cooling system is provided, as disclosed in the appended claims.

BRIEF DESCRIPTION OF THE DRAWINGS

The present invention will now be described with reference to the accompanying drawings, which show a non-limitative embodiment thereof, in which.

PREFERRED EMBODIMENTS OF THE INVENTION

Figure 1:
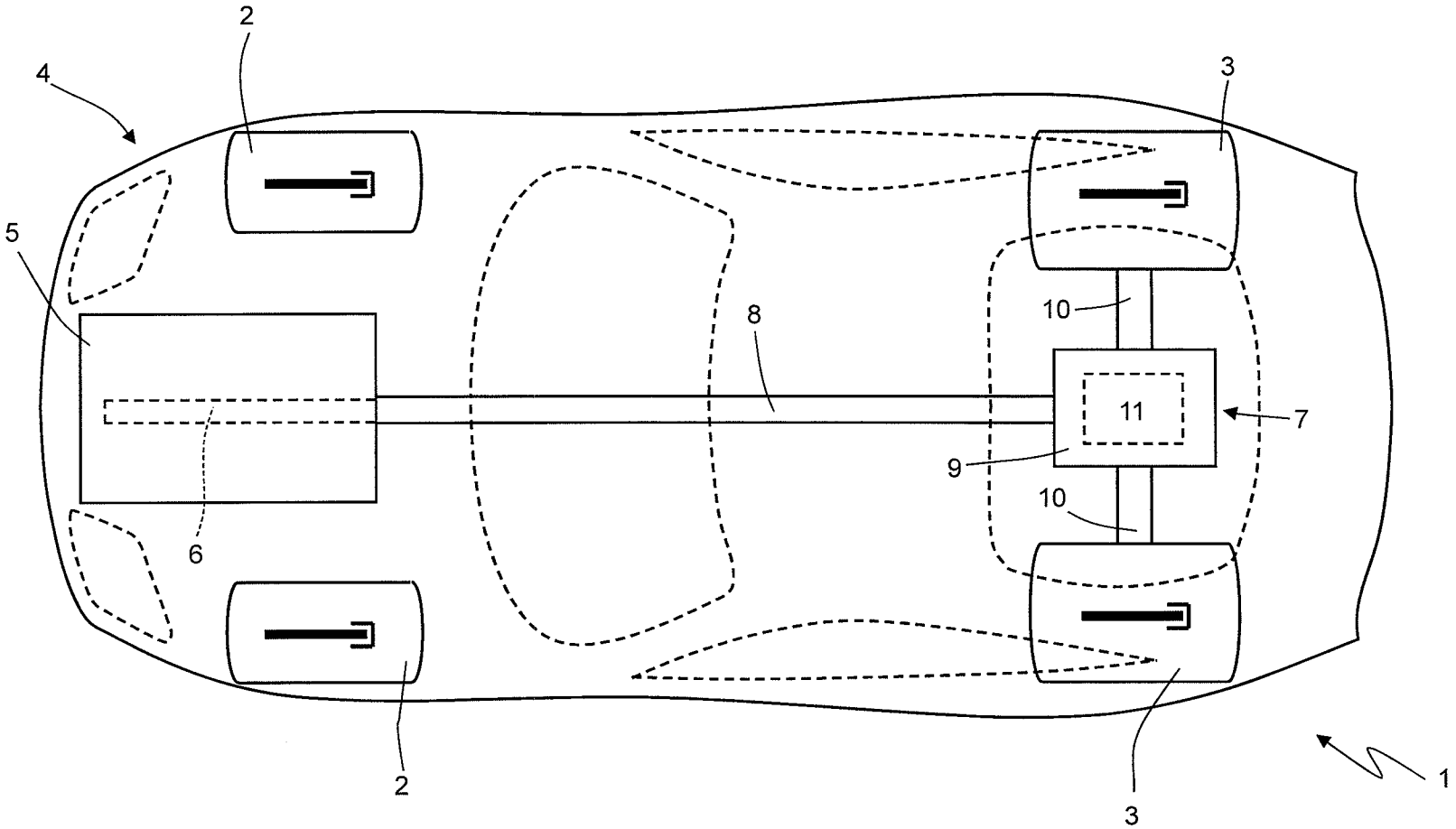
FIG. 1 is a diagrammatic plan view, with parts removed for clarity, of a vehicle which is driven by an internal combustion engine, is provided with a liquid cooling system, and is made in accordance with the present invention.

In FIG. 1, numeral 1 indicates as a whole a vehicle provided with two front wheels 2 and two rear driving wheels 3 which receive torque from a powertrain system 4. The powertrain system 4 comprises an internal combustion thermal engine 5, which is arranged in front position and is provided with a crankshaft 6, and a transmission 7, which transfers the torque generated by the internal combustion engine 5 towards the rear driving wheels 3. The transmission 7 comprises a propeller shaft 8, which on one end is angularly integral with the crankshaft 6 and on the other end is mechanically connected to a gearbox 9, which is arranged in rear position and transmits motion to the rear driving wheels 3 by means of two axles shafts 10, which receive motion from a differential 11.

Figure 2:
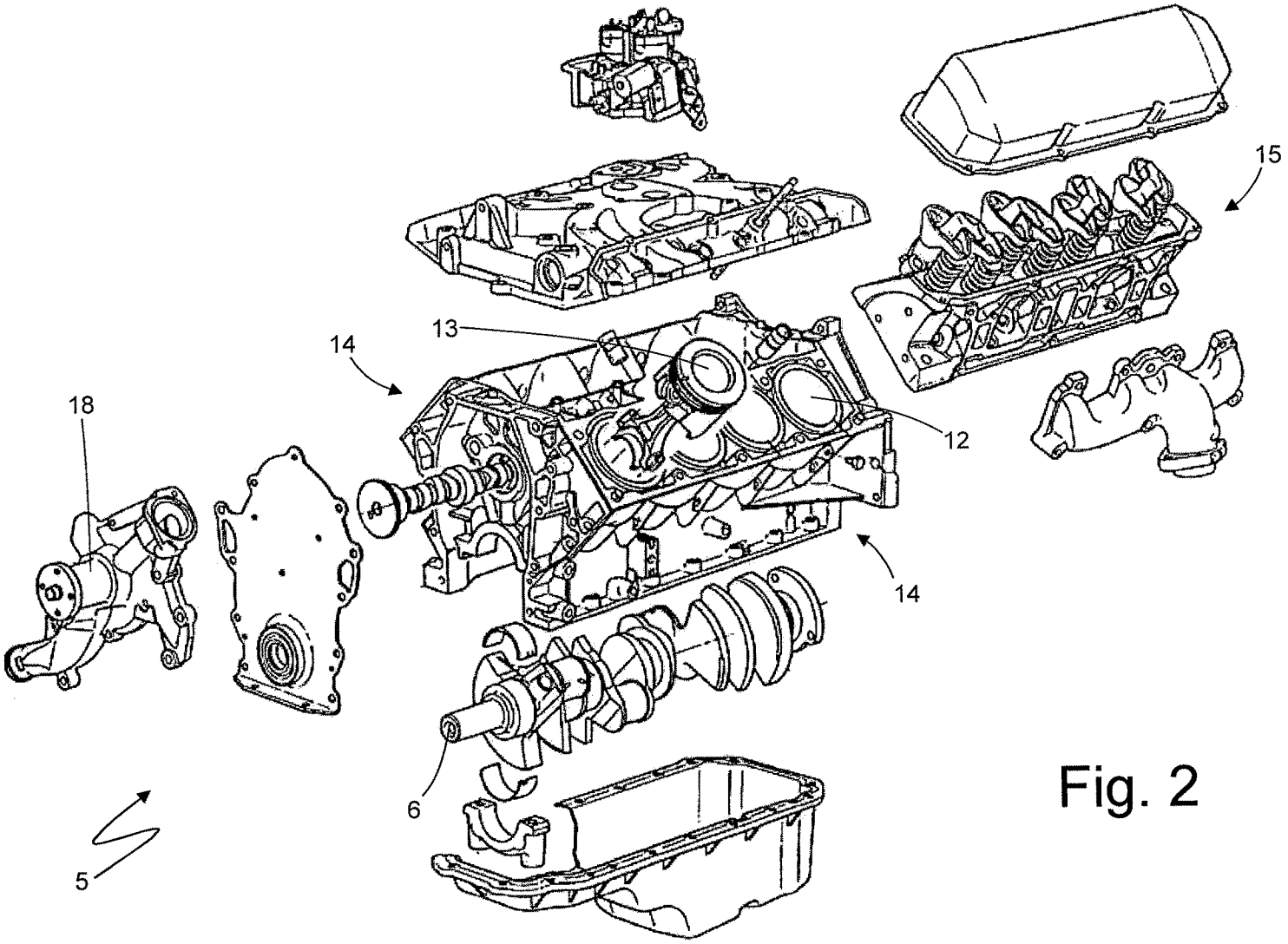
FIG. 2 is a partially exploded perspective view, with parts removed for clarity, of the internal combustion engine in FIG. 1.

As diagrammatically shown in FIG. 2, the internal combustion engine 5 has eight cylinders 12 (only four of which are shown in FIG. 2), which house corresponding pistons 13 (only one of which is shown in FIG. 2) connected to the crankshaft 6. According to the embodiment shown in FIG. 2, the internal combustion engine 5 comprises eight cylinders 12 in a "V" arrangement, i.e. the cylinders 12 are grouped into two twin rows, which are arranged at a reciprocal angle. According to a different, perfectly equivalent embodiment, the internal combustion engine 5 has a straight arrangement of the cylinders 12 and/or a number of cylinders 12. The internal combustion engine 5 comprises two cylinder blocks 14 (which form a single monolithic body) in which the cylinders 12 and two corresponding heads 15 (only one of which is shown in FIG. 2) are obtained, each of which is fixed to a corresponding cylinder block 14, defines the top (i.e. the upper closure) of the corresponding cylinders 12, and supports the distribution system (i.e. the intake and exhaust valves of the corresponding cylinders 12).

Figure 3:
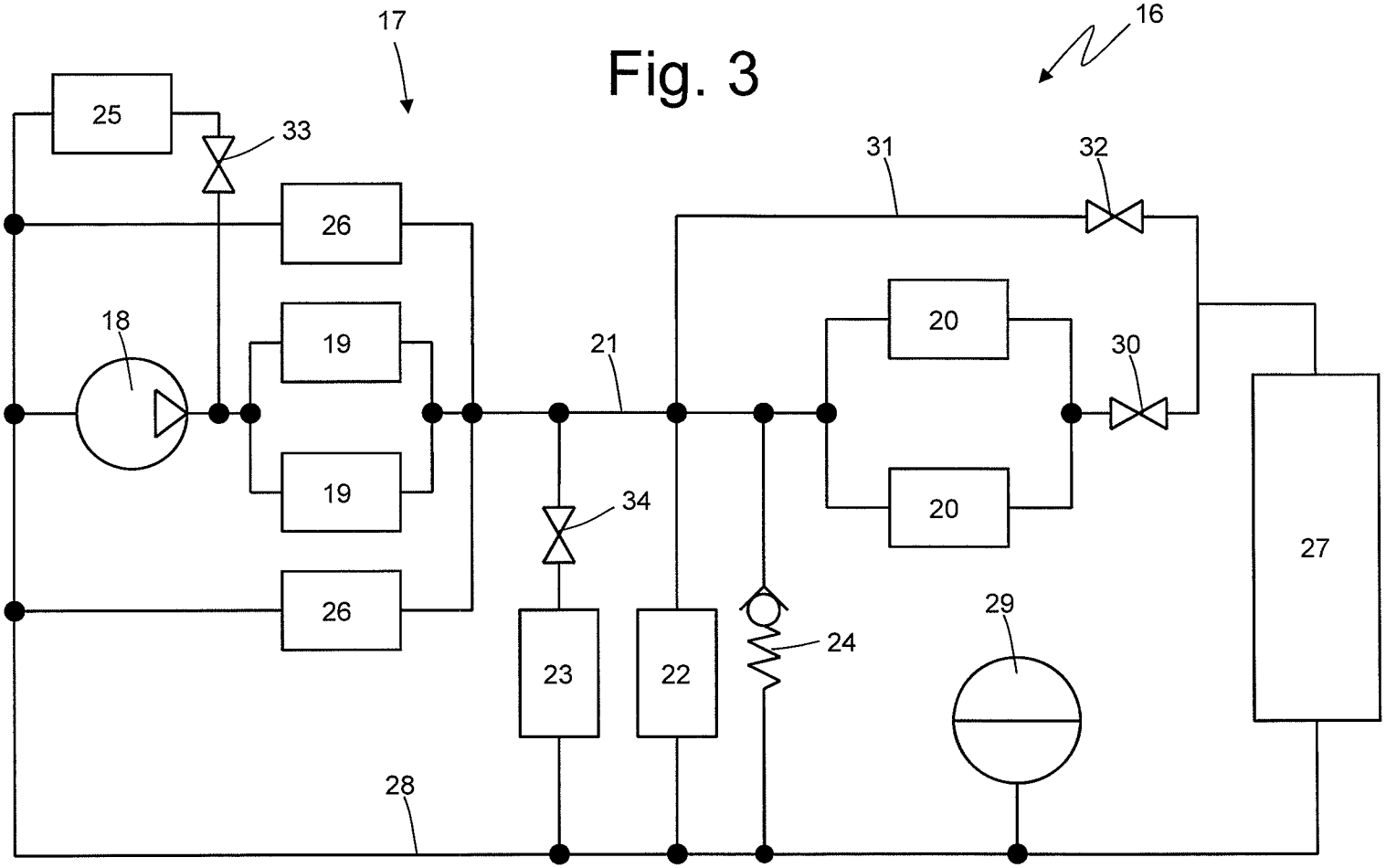
FIG. 3 is a diagrammatic view of the cooling system of the vehicle in FIG. 1.

As diagrammatically shown in FIG. 3, vehicle 1 comprises the liquid cooling system 16, which has the main task of cooling the internal combustion engine 5 and the transmission 9. The cooling system 16 comprises a hydraulic circuit 17 in which a coolant (typically water-based, i.e. consisting of water mixed with an antifreeze additive) runs and is circulated by a circulation pump 18 (also shown in FIG. 2 and actuated by the crankshaft 6).

The hydraulic circuit 17 comprises a pair of initial sections 19, each of which is obtained in a corresponding head 15 of the internal combustion engine 5, and a pair of final sections 20, each of which is obtained in a corresponding cylinder block 14 of the internal combustion engine 5. In the hydraulic circuit 17, a delivery of the circulation pump 18 is directly connected (i.e. without the interposition of other elements different from pipes) connected to an inlet of each initial section 19 obtained in a corresponding head 15 of the internal combustion engine 5; in other words, the delivery of the circulation pump 18 is directly connected with means of respective pipes (without the interposition of other elements) to the inlets of the initial sections 19. The two initial sections 19 are connected to each other in parallel and in entirely symmetric manner. Furthermore, in the hydraulic circuit 17, an outlet of each initial section 19 obtained in a corresponding head 15 of the internal combustion engine 5 is directly connected (i.e. without the interposition of elements other than pipes) to an inlet of each final section 20 obtained in a corresponding cylinder block 14 of the internal combustion engine 5; in this manner, the final sections 20 are arranged in series relative to the initial sections 19 and downstream of the initial sections 19 themselves. In other words, the outlets of the sections 19 are connected directly by means of respective pipes (i.e. without the interposition of other elements different from pipes) to the inlets of the final sections 20. The two final sections 20 are connected to each other in parallel and in entirely symmetric manner.

According to a preferred embodiment shown in FIG. 3, a manifold 21 (which in all cases is a pipe), to which various elements are connected as will be explained below, is interposed between the initial sections 19 and the final sections 20.

The cooling system 16 comprises a heat exchanger 22, which is adapted to cool a lubricant of the internal combustion engine 5 and is crossed by the hydraulic circuit 17. In the hydraulic circuit 17, the outlet of the initial sections 19 obtained in the heads 15 of the internal combustion engine 5 is directly connected (i.e. without the interposition of other elements different from pipes) to an inlet of the heat exchanger 22 so that the heat exchanger 22 is arranged in series relative to the initial sections 19 and downstream of the initial sections 19 themselves; i.e. the inlet of the heat exchanger 22 is directly connected (i.e. without the interposition of other elements different from pipes) to the manifold 21. An outlet of the heat exchanger 22 is directly connected (i.e. without the interposition of other elements different from pipes) to an intake of the circulation pump 18.

The cooling system 16 comprises a heat exchanger 23, which is coupled to an air conditioning system of vehicle 1 and is crossed by the hydraulic circuit 17. In the hydraulic circuit 17, the outlet of the initial sections 19 obtained in the heads 15 of the internal combustion engine 5 is directly connected (i.e. without the interposition of other elements different from pipes) to an inlet of the heat exchanger 23 so that the heat exchanger 23 is arranged in series to the initial sections 19 and downstream of the initial sections 19 themselves; i.e. the inlet of the heat exchanger 23 is directly connected (i.e. without the interposition of other elements different from pipes) to the manifold 21. An outlet of the heat exchanger 23 is directly connected (i.e. without the interposition of other elements different from pipes) to an intake of the circulation pump 18.

The cooling system 16 comprises a high-pressure valve 24, which opens when the pressure at its ends exceeds a predetermined threshold value; the function of the high-pressure valve 24 is to prevent the coolant pressure to increase to excessively high values. The high-pressure valve 24 is of the ON/OFF type, i.e. has only two possible operative positions: either all closed or all open. In the hydraulic circuit 17, the outlet of the initial sections 19 obtained in the heads 15 of the internal combustion engine 5 is directly connected (i.e. without the interposition of other elements different from pipes) to an inlet of the high-pressure valve 24 so that the high-pressure valve 24 is arranged in series relative to the initial sections 19 and downstream of the initial sections 19 themselves; i.e. the inlet of the high-pressure valve 24 is directly connected (i.e. without the interposition of other elements different from pipes) to the manifold 21. An outlet of the high-pressure valve 24 is directly connected (i.e. without the interposition of other elements different from pipes) to an intake of the circulation pump 18.

It is thus apparent that the heat exchangers 22 and 23 and the high-pressure valve 24 are reciprocally connected in parallel.

The cooling system 16 comprises a heat exchanger 25, which is adapted to cool a lubricant of the drivetrain 7 and is crossed by the hydraulic circuit 17. In the hydraulic circuit 17, an inlet of the heat exchanger 25 is directly connected (i.e. without the interposition of other elements different from pipes) to an intake of the circulation pump 18 and the outlet of the heat exchanger 25 is directly connected (i.e. without the interposition of other elements different from pipes) to the circulation pump 18. In other words, the heat exchanger 25 is connected in parallel relative to the circulation pump 18.

According to a possible embodiment, the internal combustion engine 5 is turbocharged and comprises a pair of turbochargers, each of which is associated to a corresponding cylinder row 12. In this embodiment, the cooling system 16 comprises a heat exchanger 26, which is adapted to cool a lubricant oil of the turbocharger and is crossed by the hydraulic circuit 17 for each turbocharger. In the hydraulic circuit 17, an inlet of each heat exchanger 26 is directly connected (i.e. without the interposition of other elements different from pipes) to the intake of the circulation pump 18 and an outlet of each heat exchanger 26 is directly connected (i.e. without the interposition of other elements different from pipes) to the outlet of the initial sections 19 obtained in the head 15 of the internal combustion engine 5. In other words, in the hydraulic circuit 17 the inlet of each heat exchanger 26 is directly connected (i.e. without the interposition of other elements different from pipes) to the intake of the circulation pump 18 and the outlet of each heat exchanger 26 is directly connected (i.e. without the interposition of other elements different from pipes) to the manifold 21.

The cooling system 16 comprises a radiator 27, which is adapted to cool the coolant and is crossed by the hydraulic circuit 17; alternatively, the cooling system 16 may comprise two different radiators 27 connected to each other in series one after the other. Radiator 27 is a water/air heat exchanger and in vehicle 1 is arranged generally in frontal position to be struck by air when vehicle 1 is moving. In the hydraulic circuit 17, an inlet of radiator 27 is directly connected (i.e.

without the interposition of other elements different from pipes) to one of the outlets of the final sections 20 obtained in the cylinder blocks 14 of the internal combustion engine 5 and an outlet of radiator 27 is directly connected (i.e. without the interposition of other elements different from pipes) to the intake of the circulation pump 18.

According to a preferred embodiment shown in FIG. 3, a manifold 28 is arranged at the intake of the circulation pump 18 to which various elements are connected. In particular, the following are connected to manifold 28: the intake of the circulation pump 18, the intake of the heat exchangers 25 and 26, the outlet of the heat exchangers 22 and 23, the high-pressure valve 24 and the outlet of radiator 27.

According to a preferred embodiment shown in FIG. 3, the hydraulic circuit 17 comprises an expansion tank 29 which is directly connected (i.e. without the interposition of other elements different from pipes) to manifold 28 (i.e. to the outlet of radiator 27 and to the intake of the circulation pump 18).

According to a preferred embodiment shown in FIG. 3, the hydraulic circuit 17 comprises a shut-off valve 30, which is arranged in series relative to the final sections 20 obtained in the cylinder blocks 14 of the internal combustion engine 5; in other words, the shut-off valve 30 may be arranged immediately downstream of the outlets of the final sections 20 (as shown in FIG. 3) or immediately upstream of the final sections 20 (variant not shown). Preferably, shut-off valve 30 is of the ON/OFF type, i.e. has only two possible operative positions: either all closed or all open. The function of the shut-off valve 30 is to block the circulation of coolant through the final sections 20 obtained in the cylinder blocks 14 of the internal combustion engine 5; in other words, when the shut-off valve 30 is open the coolant circulates also through the final sections 20, while when the shut-off valve 30 is closed the coolant does not flow through the final sections 20.

According to a preferred embodiment shown in FIG. 3, the hydraulic circuit 17 comprises a bypass duct 31, which is arranged in parallel to the final sections 20 obtained in the cylinder blocks 14 of the internal combustion engine 5, and a shut-off valve 32 which is arranged along the bypass duct 31. Preferably, shut-off valve 32 is of the ON/OFF type, i.e. has only two possible operative positions: either all closed or all open. The function of the shut-off valve 32 is to block the circulation of the coolant through the bypass pipe 31; in other words, when the shut-off valve 32 is open the coolant circulates also through the bypass duct 31, while when the shut-off valve 32 is closed the coolant does not flow through the bypass duct 31.

According to a possible embodiment, the two shut-off valves 30 and 32 could also be part of the same structure, i.e. could be obtained in a single valve body (possibly three-way).

The shut-off valves 30 and 32 are of the ON/OFF type (i.e. have only an all open position and an all closed position) and may be passive (i.e. are thermostatic valves and open/close autonomously as a function of the temperature of the coolant) or of the active type (i.e. are controlled by an actuator driven by an electronic control unit). According to an alternative embodiment (not shown), the shut-off valve 30 could be of the continuous type, i.e. could assume partial opening configurations to adjust the flow of coolant which circulates through the final sections 20 obtained in the cylinder blocks 14 of the internal combustion engine 5 more finely.

According to a possible embodiment shown in FIG. 3, the hydraulic circuit 17 comprises a shut-off valve 33 which is arranged in series relative to the heat exchanger 25. The function of the shut-off valve 33 is to block the circulation of the coolant through the heat exchanger 25; in other words, when the shut-off valve 33 is open the coolant circulates also through the heat exchanger 25, while when the shut-off valve 33 is closed the coolant does not flow through the heat exchanger 25. The shut-off valve 33 is of the ON/OFF type (i.e. has only one all open position and an all closed position) and is of the active type (i.e. is controlled by an actuator controlled by an electronic control unit).

According to a possible embodiment shown in FIG. 3, the hydraulic circuit 17 comprises a shut-off valve 34 which is arranged in series relative to the heat exchanger 23. The function of the shut-off valve 33 is to block the circulation of the coolant through the heat exchanger 23; in other words, when the shut-off valve 34 is open the coolant circulates also through the heat exchanger 23, while when the shut-off valve 34 is closed the coolant does not flow through the heat exchanger 23. The shut-off valve 34 is of the ON/OFF type (i.e. has only one all open position and an all closed position) and is of the active type (i.e. is controlled by an actuator controlled by an electronic control unit).

The operation of the cooling system 16 is described below.

Both shut-off valves 30 and 32 are closed when the internal combustion engine 5 is cold, i.e. when the temperature of the coolant which circulates through the hydraulic circuit 17 is lower in temperature than the optimal working temperature: in this manner, the coolant pushed by the circulation pump 18 crosses the initial sections 19 obtained in the heads 15 of the internal combustion engine 5 and thus crosses the heat exchanger 22 (possibly, if required, also through the heat exchanger 23 coupled to the climate control system) and does not pass through the final sections 20 obtained in the cylinder blocks 14 of the internal combustion engine 5 nor through radiator 27.

Operating as described above, when the internal combustion engine 5 is cold the heat produced by the combustion is initially used to heat the coolant and to heat the lubrication oil of the internal combustion engine 5 (through the heat exchanger 22). The rapid heating of the lubrication oil of the internal combustion engine 5 allows to make the lubrication oil more fluid and thus to reduce the friction inside the internal combustion engine 5 in appreciable manner; therefore, fuel consumption can be reduced during the step of warming up of the internal combustion engine 5.

Operating as described above, when the internal combustion engine 5 is cold, the temperature of the cylinder blocks 14 of the internal combustion engine 5 is relatively high (because the coolant does not circulate through the final sections 20 of the hydraulic circuit 17). The temperature of the walls of the cylinders 12 (i.e. the temperature of the liners of the cylinders 12) is maintained relatively high by avoiding the cooling of the cylinder blocks 14 of the internal combustion engine 5 (obviously only during the step of warming up). In this manner, the friction between the cylinders 12 and the pistons 13 can be reduced during the step of warming up of the internal combustion engine 5; therefore, fuel consumption during the step of warming up of the internal combustion engine 5 can be reduced.

The shut-off valve 30 is open and the shut-off valve 32 is closed when the internal combustion engine 5 is warm, i.e. when the coolant which circulates through the hydraulic circuit 17 has reached the optimal working temperature. Operating as described above, when the internal combustion engine 5 is warm, the coolant coming from the radiator (thus at lower temperature) and pumped by the circulation pump 18 is initially and exclusively sent to the initial sections 19 obtained in the heads 15 of the internal combustion engine 5 and only later to the final sections 20 obtained in the cylinder blocks 14 of the internal combustion engine 5; in this manner, a greater cooling to the heads 15 of the internal combustion engine 5 can be guaranteed thus obtaining a significant limitation of the maximum temperatures reached by the heads 15 themselves, particularly during sporty use (i.e. when the internal combustion engine 5 must deliver high power for a long time). In other words, particularly in sporty use, the maximum possible cooling is guaranteed to the heads 15 of the internal combustion engine 5 to the detriment of the cylinder blocks 14 of the internal combustion engine 5; however, in the high specific power internal combustion engine 5 and in sporty use, the problems of excessively high temperatures are more concentrated in the heads rather than in the cylinder blocks, and thus guaranteeing the maximum possible cooling to the heads 15 of the internal combustion engine 5 is certainly advantageous.

When the internal combustion engine 5 is warm (but at relatively low temperatures), an operating mode which includes keeping the shut-off valve 30 closed and the shut-off valve 32 open could be possible (generally for a short period of time). Operating as described above, the coolant coming from the radiator (thus at lower temperature) and pumped by the circulation pump 18 is exclusively sent to the initial sections 19 obtained in the heads 15 of the internal combustion engine 5 and does not circulate through the final sections 20 obtained in the cylinder blocks 14 of the internal combustion engine 5. This operating mode allows to adequately cool the heads 15 of the internal combustion engine 5 without cooling the cylinder blocks 14 of the internal combustion engine 5 at the same time.

The vehicle 1 described above has many advantages.

Firstly, the cooling system 16 of vehicle 1 allows to reduce the frictions (and thus the fuel consumption and the polluting emissions) in significant manner during the step of warming up of the internal combustion engine 5.

Furthermore, the cooling system 16 of vehicle 1 allows to keep the maximum temperatures reached by the heads 15 of the internal combustion engine 5 within acceptable values also in sporty use.

Finally, the cooling system 16 of vehicle 1 is simple and cost-effective to be implemented and has small overall dimensions.

The invention claimed is:

1. A vehicle comprising:

an internal combustion engine comprising: a plurality of cylinders housing respective pistons, at least one cylinder block, in which the cylinders are obtained, and at least one head, which is fixed to the cylinder block, defines the top of the cylinders and supports a distribution system; and a liquid cooling system comprising a hydraulic circuit, inside which a coolant flows, whose circulation is caused by a circulation pump;

wherein the hydraulic circuit comprises an initial section, which is obtained inside the head of the internal combustion engine, and a final section, which is obtained inside the cylinder block of the internal combustion engine;

wherein, in the hydraulic circuit, a delivery of the circulation pump is directly connected to an inlet of the initial section obtained inside the head of the internal combustion engine;

wherein, in the hydraulic circuit, an outlet of the initial section obtained inside the head of the internal combustion engine is directly connected to an inlet of the final section obtained inside the cylinder block of the internal combustion engine, so that the final section is arranged in series relative to the initial section and downstream of the initial section;

wherein the hydraulic circuit comprises: a first shut-off valve, which is arranged in series relative to the final section obtained inside the cylinder block of the internal combustion engine to prevent the flow of coolant through the final section; a bypass duct, which is free from heat exchangers, and is arranged in parallel relative to the final section and to the first shut-off valve arranged in series relative to the final section; and a second shut-off valve, which is arranged along the bypass duct and has the function of blocking the circulation of the coolant through the bypass pipe only; and wherein the bypass duct originates at an inlet of the final section, ends at an outlet of the final section, and allows the coolant to bypass the final section.

2. A vehicle according to claim 1, wherein:

the cooling system comprises a first heat exchanger, which is adapted to cool a lubricant of the internal combustion engine and is crossed by the hydraulic circuit; and in the hydraulic circuit, the outlet of the initial section obtained inside the head of the internal combustion engine is directly connected to an inlet of the first heat exchanger, so that the first heat exchanger is arranged in series relative to the initial section and downstream of the initial section.

3. A vehicle according to claim 2, wherein an outlet of the first heat exchanger is directly connected to an intake of the circulation pump.

4. A vehicle according to claim 1, wherein:

the cooling system comprises a second heat exchanger, which is coupled to an air conditioning system of the vehicle and is crossed by the hydraulic circuit; and in the hydraulic circuit, the outlet of the initial section obtained inside the head of the internal combustion engine is directly connected to an inlet of the second heat exchanger, so that the second heat exchanger is arranged in series relative to the initial section and downstream of the initial section.

5. A vehicle according to claim 4, wherein an outlet of the second heat exchanger is directly connected to an intake of the circulation pump.

6. A vehicle according to claim 1, wherein:

the cooling system comprises a high-pressure valve, which opens when the pressure at its ends exceeds a predetermined threshold value; and in the hydraulic circuit, the outlet of the initial section obtained inside the head of the internal combustion engine is directly connected to an inlet of the high-pressure valve, so that the high-pressure valve is arranged in series relative to the initial section and downstream of the initial section.

7. A vehicle according to claim 6, wherein an outlet of the high-pressure valve is directly connected to an intake of the circulation pump.

8. A vehicle according to claim 1, wherein:

the internal combustion engine comprises at least one turbocharger;

the cooling system comprises a third heat exchanger, which is adapted to cool a lubricant of the turbocharger and is crossed by the hydraulic circuit; and in the hydraulic circuit, an inlet of the third heat exchanger is directly connected to an intake of the circulation pump and an outlet of the third heat exchanger is directly connected to the outlet of the initial section obtained inside the head of the internal combustion engine.

9. A vehicle according to claim 1, wherein:

it is provided a drivetrain, which transmits power from the crankshaft of the internal combustion engine to driving wheels of the vehicle;

the cooling system comprises a fourth heat exchanger, which is adapted to cool a lubricant of the drivetrain and is crossed by the hydraulic circuit; and in the hydraulic circuit, an inlet of the fourth heat exchanger is directly connected to an intake of the circulation pump and an outlet of the fourth heat exchanger is directly connected to the delivery of the circulation pump.

10. A vehicle according to claim 1, wherein:

the cooling system comprises at least one radiator, which is adapted to cool the coolant and is crossed by the hydraulic circuit; and in the hydraulic circuit, an inlet of the radiator is directly connected to an outlet of the final section obtained inside the cylinder block of the internal combustion engine and an outlet of the radiator is directly connected to an intake of the circulation pump.

11. A vehicle according to claim 10, wherein the hydraulic circuit comprises an expansion tank, which is directly connected to the outlet of the radiator, namely to the intake of the circulation pump.

12. A vehicle comprising:

an internal combustion engine comprising: a plurality of cylinders housing respective pistons, at least one cylinder block, in which the cylinders are obtained, and at least one head, which is fixed to the cylinder block, defines the top of the cylinders and supports a distribution system; and a liquid cooling system comprising a hydraulic circuit, inside which a coolant flows, whose circulation is caused by a circulation pump;

wherein the hydraulic circuit comprises an initial section, which is obtained inside the head of the internal combustion engine, and a final section, which is obtained inside the cylinder block of the internal combustion engine;

wherein, in the hydraulic circuit, a delivery of the circulation pump is directly connected to an inlet of the initial section obtained inside the head of the internal combustion engine;

wherein, in the hydraulic circuit, an outlet of the initial section obtained inside the head of the internal combustion engine is directly connected to an inlet of the final section obtained inside the cylinder block of the internal combustion engine, so that the final section is arranged in series relative to the initial section and downstream of the initial section;

wherein the hydraulic circuit comprises: a first shut-off valve, which is arranged in series relative to the final section obtained inside the cylinder block of the internal combustion engine to prevent the flow of coolant through the final section; a bypass duct, which is free from heat exchangers, and is arranged in parallel relative to the final section and to the first shut-off valve arranged in series relative to the final section; and a second shut-off valve, which is arranged along the bypass duct and has the function of blocking the circulation of the coolant through the bypass pipe only;

wherein the bypass duct originates at an inlet of the final section, ends at an outlet of the final section, and allows the coolant to bypass the final section;

wherein the cooling system comprises a high-pressure valve, which opens when the pressure at its ends exceeds a predetermined threshold value;

wherein in the hydraulic circuit, the outlet of the initial section obtained inside the head of the internal combustion engine is directly connected to an inlet of the high-pressure valve, so that the high-pressure valve is arranged in series relative to the initial section and downstream of the initial section; and wherein an outlet of the high-pressure valve is directly connected to an intake of the circulation pump.

13. A vehicle comprising:

an internal combustion engine comprising: a plurality of cylinders housing respective pistons, at least one cylinder block, in which the cylinders are obtained, and at least one head, which is fixed to the cylinder block, defines the top of the cylinders and supports a distribution system; and a liquid cooling system comprising a hydraulic circuit, inside which a coolant flows, whose circulation is caused by a circulation pump;

wherein the hydraulic circuit comprises an initial section, which is obtained inside the head of the internal combustion engine, and a final section, which is obtained inside the cylinder block of the internal combustion engine;

wherein, in the hydraulic circuit, a delivery of the circulation pump is directly connected to an inlet of the initial section obtained inside the head of the internal combustion engine;

wherein, in the hydraulic circuit, an outlet of the initial section obtained inside the head of the internal combustion engine is directly connected to an inlet of the final section obtained inside the cylinder block of the internal combustion engine, so that the final section is arranged in series relative to the initial section and downstream of the initial section;

wherein the hydraulic circuit comprises: a first shut-off valve, which is arranged in series relative to the final section obtained inside the cylinder block of the internal combustion engine to prevent the flow of coolant through the final section; a bypass duct, which is free from heat exchangers, and is arranged in parallel relative to the final section and to the first shut-off valve arranged in series relative to the final section; and a second shut-off valve, which is arranged along the bypass duct and has the function of blocking the circulation of the coolant through the bypass pipe only;

wherein the bypass duct originates at an inlet of the final section, ends at an outlet of the final section, and allows the coolant to bypass the final section;

wherein the cooling system comprises a first heat exchanger, which is adapted to cool a lubricant of the internal combustion engine and is crossed by the hydraulic circuit;

wherein in the hydraulic circuit, the outlet of the initial section obtained inside the head of the internal combustion engine is directly connected to an inlet of the first heat exchanger, so that the first heat exchanger is arranged in series relative to the initial section and downstream of the initial section;

wherein an outlet of the first heat exchanger is directly connected to an intake of the circulation pump;

wherein the cooling system comprises a second heat exchanger, which is arranged in parallel to the first heat exchanger, is coupled to an air conditioning system of the vehicle and is crossed by the hydraulic circuit;

wherein in the hydraulic circuit, the outlet of the initial section obtained inside the head of the internal combustion engine is directly connected to an inlet of the second heat exchanger, so that the second heat exchanger is arranged in series relative to the initial section and downstream of the initial section; and wherein an outlet of the second heat exchanger is directly connected to an intake of the circulation pump.

* * * * *